US009004888B2

(12) United States Patent
Morishita

(10) Patent No.: US 9,004,888 B2
(45) Date of Patent: Apr. 14, 2015

(54) ROTARY COMPRESSOR HAVING DISCHARGE GROOVE TO COMMUNICATE COMPRESSION CHAMBER WITH DISCHARGE PORT NEAR VANE GROOVE

(71) Applicant: Fujitsu General Limited, Kawasaki (JP)

(72) Inventor: Taku Morishita, Kawasaki (JP)

(73) Assignee: Fujitsu General Limited, Kanagawa (JP)

( * ) Notice: Subject to any disclaimer, the term of this patent is extended or adjusted under 35 U.S.C. 154(b) by 0 days.

(21) Appl. No.: 14/065,263

(22) Filed: Oct. 28, 2013

(65) Prior Publication Data

US 2014/0119968 A1 May 1, 2014

(30) Foreign Application Priority Data

Oct. 30, 2012 (JP) ..... 2012-239642

(51) Int. Cl.

| | |
|---|---|
| ***F03C 2/00*** | (2006.01) |
| ***F03C 4/00*** | (2006.01) |
| ***F04C 11/00*** | (2006.01) |
| ***F04C 18/22*** | (2006.01) |
| ***F04C 29/12*** | (2006.01) |
| ***F04C 18/356*** | (2006.01) |

(52) U.S. Cl.

CPC ..... *F04C 18/22* (2013.01); *F04C 29/12* (2013.01); *F04C 29/124* (2013.01); *F04C 18/3564* (2013.01)

(58) Field of Classification Search

CPC .... F04C 18/3564; F04C 23/008; F04C 29/12; F04C 29/124; F04C 29/126; F04C 29/128

USPC ..... 418/11, 15, 60, 63, 270, 150

See application file for complete search history.

(56) References Cited

U.S. PATENT DOCUMENTS

| | | | | | |
|---|---|---|---|---|---|
| 4,537,567 | A | * | 8/1985 | Kawaguchi et al. | 418/63 |
| 5,823,755 | A | * | 10/1998 | Wilson et al. | 418/63 |
| 6,042,351 | A | * | 3/2000 | Bushnell et al. | 418/63 |

FOREIGN PATENT DOCUMENTS

| | | | | | |
|---|---|---|---|---|---|
| JP | 59158396 | A | * | 9/1984 | 418/63 |
| JP | 05-133363 | | | 5/1993 | |
| JP | 2007-198319 | | | 8/2007 | |

* cited by examiner

*Primary Examiner* — Theresa Trieu

(74) *Attorney, Agent, or Firm* — McDermott Will & Emery LLP

(57) ABSTRACT

A rotary compressor includes a compression unit that includes an annular cylinder including a cylinder inner wall, a suction port, and a vane groove, an end plate covering an end portion of the cylinder, an annular piston revolving in the cylinder to form an actuation chamber between the cylinder inner wall and the annular piston; and a vane protruding into the actuation chamber to divide the actuation chamber into a suction chamber and a compression chamber. A discharge port, which is provided in the end plate near the vane groove, communicates with the compression chamber, and a discharge groove, which is provided in the cylinder inner wall near the vane groove, communicates the compression chamber with the discharge port, and one side end portion of the discharge groove is located in an end portion of a wall portion of the vane groove on the compression chamber side.

4 Claims, 5 Drawing Sheets

CONVENTIONAL ART

ROTARY COMPRESSOR HAVING DISCHARGE GROOVE TO COMMUNICATE COMPRESSION CHAMBER WITH DISCHARGE PORT NEAR VANE GROOVE

CROSS-REFERENCE TO RELATED APPLICATIONS

This application is based upon and claims the benefit of priority from Japanese Patent Application No. 2012-239642, filed Oct. 30, 2012, the entire contents of which are incorporated herein by reference.

BACKGROUND OF THE INVENTION

1. Field of the Invention

The present invention relates to a rotary compressor used for an air conditioner, for example.

2. Description of the Related Art

FIG. 7 is an enlarged cross sectional view illustrating first and second compression units of a conventional rotary compressor, and FIG. 8 is an enlarged cross sectional view of D portion of FIG. 7. As illustrated in FIG. 7 and FIG. 8, the conventional rotary compressor has a compression unit 52 which includes annular cylinders 521S, 521T in which suction ports (not illustrated) and vane grooves 528S, 528T are radially provided to the side portion thereof, and an end plate (not illustrated) which covers end portions of the cylinders 521S, 521T, annular pistons 125S, 125T which fit into eccentric portions 152S, 152T of a rotary shaft rotated by a motor and revolve in the cylinders 521S and 521T along cylinder inner walls 523S, 523T of the cylinders 521S, 521T and form actuation chambers 130S, 130T between the cylinder inner walls 523S, 523T, and vanes 127S, 127T which protrude into the actuation chambers 130S, 130T from insides of vane grooves 528S, 528T provided in the cylinders 521S, 521T so as to abut against the annular pistons 125S, 125T and divide the actuation chambers 130S, 130T into suction chambers 131S, 131T, and compression chambers 133S, 133T, wherein discharge ports 190S, 190T which discharge compressed refrigerants in the compression chambers 133S, 133T outside the compression chambers 133S, 133T are provided near the vane grooves 528S, 528T of end plates (not illustrated), and notch portions 537S, 537T which guide compressed refrigerants in the compression chambers 133S, 133T to the discharge ports 190S, 190T are provided near the vane grooves 528S, 528T of the cylinders 521S, 521T.

A rotary compressor which has the above-stated configurations has had a problem that after the annular pistons 125S, 125T revolve in the cylinders 521S, 521T and pass through the discharge ports 190S, 190T, in small spaces 538S, 538T surrounded by the cylinder inner walls 523S, 523T, the annular pistons 125S, 125T, and the vanes 127S, 127T, refrigerant gas which is not discharged from the discharge ports 190S, 190T is compressed resulting in over compression loss which causes decrease in compression effect and worsening of COP.

Conventionally, a closed compressor (rotary compressor) including a closed container and electric elements and compression elements contained in the closed container, the compression elements being composed of a cylinder having an actuation chamber inside the cylinder, a roller (annular piston) which rotates in the cylinder by an eccentric portion of a rotary shaft thereof, a vane which contacts with the roller and slides a guide groove provided in the cylinder so as to divide the actuation chamber of the cylinder into a compression chamber and a suction chamber, and a frame (end plate) which seals the actuation chamber of the cylinder, the frame being provided with a discharge port which communicates with the compression chamber of the cylinder, wherein the discharge port is located completely inside the compression chamber of the cylinder and shaped in a circle, a long hole, or a crescent which does not protrude inside of an inner circumferential edge of the roller, moreover, the roller is shaped in a cylinder or a cylinder whose end face portion at the discharge port side is thick is disclosed (for example, refer to Japanese Patent Application Laid-open No. 05-133363.)

Additionally, a closed rotary compressor enclosing a motor unit and a rotary compression mechanism connected to the motor unit via a rotary shaft in a closed case, the rotary compression mechanism including a cylinder which forms a cylinder chamber, first and second cover members provided on both end faces of the cylinder so as to cover the cylinder chamber, and a roller and a vane which separate the cylinder chamber interior into a compression chamber and a suction chamber, wherein a discharge port for discharging a refrigerant compressed in the cylinder chamber is provided in at least one of the first and second cover members, provided a cross sectional area of the compression chamber when the vane is in a lower dead position is B ($m^2$) and a cross sectional area of the discharge port is C ($m^2$), the discharge port is set so as to satisfy $C/B \leq 0.15$, and the length of the discharge port is set to be 3 mm or less, moreover, a proportion of area that the discharge port faces the cylinder chamber is set to be 87% or more of the cross sectional area of the discharge port, and the cylinder is not provided with a notch groove for refrigerant discharge, is disclosed (for example, refer to Japanese Patent Application Laid-open No. 2007-198319.)

However, according to the conventional art disclosed in Japanese Patent Application Laid-open No. 05-133363, since the discharge port is located completely inside the compression chamber of the cylinder and a discharge notch is not provided in the compression chamber of the cylinder, although it is possible to decrease re-expansion loss, after the roller passes through the discharge port, refrigerant gas which is not discharged is compressed resulting in over compression loss in a space surrounded by the inner wall of the cylinder, the roller, and the vane, and the high pressure refrigerant gas returns to the suction chamber side of low pressure, causing decrease in compression effect and worsening of COP, which must be the problem.

Moreover, according to the conventional art disclosed in Japanese Patent Application Laid-open No. 2007-198319, since the proportion of area that the discharge port faces the cylinder chamber is 87% or more of the cross sectional area of the discharge port, volume of the space surrounded by the inner wall of the cylinder, the roller, and the vane after the roller passes through the discharge port decreases compared with that of Japanese Patent Application Laid-open No. 05-133363 so that the over compression loss slightly decreases, but still, the compression effect decreases and the COP of the whole refrigeration cycle worsens.

The present invention has been made considering the above-stated matters and aims to decrease the over compression loss and improve the compression effect so as to obtain a rotary compressor with better COP.

SUMMARY OF THE INVENTION

It is an object of the present invention to at least partially solve the problems in the conventional technology. According to an aspect of the present invention, a rotary compressor comprises a compression unit that includes an annular cylinder including a suction port and a vane groove which are radially provided to a side portion thereof; an end plate which covers an end portion of the cylinder; an annular piston which is fitted into an eccentric portion of a rotary shaft rotated by a motor and revolves in the cylinder along a cylinder inner wall of the cylinder so as to form an actuation chamber between the cylinder inner wall and the annular piston; and a vane which protrudes into the actuation chamber from an inside of the vane groove provided in the cylinder so as to abut against the annular piston and divide the actuation chamber into a suction chamber and a compression chamber. A discharge port is provided in the end plate near the vane groove, the discharge port communicates with the compression chamber, and a part of the discharge port is located outside the cylinder inner wall; and a discharge groove is provided in the cylinder inner wall near the vane groove, the discharge groove communicates the compression chamber with the discharge port, and one side end portion of the discharge groove is located in an end portion of a wall portion of the vane groove on a compression chamber side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereafter, embodiments of the rotary compressor according to the present invention are described in detail with reference to the drawings. Note that, the invention is not limited by the embodiments.

First Embodiment

Figure 1:
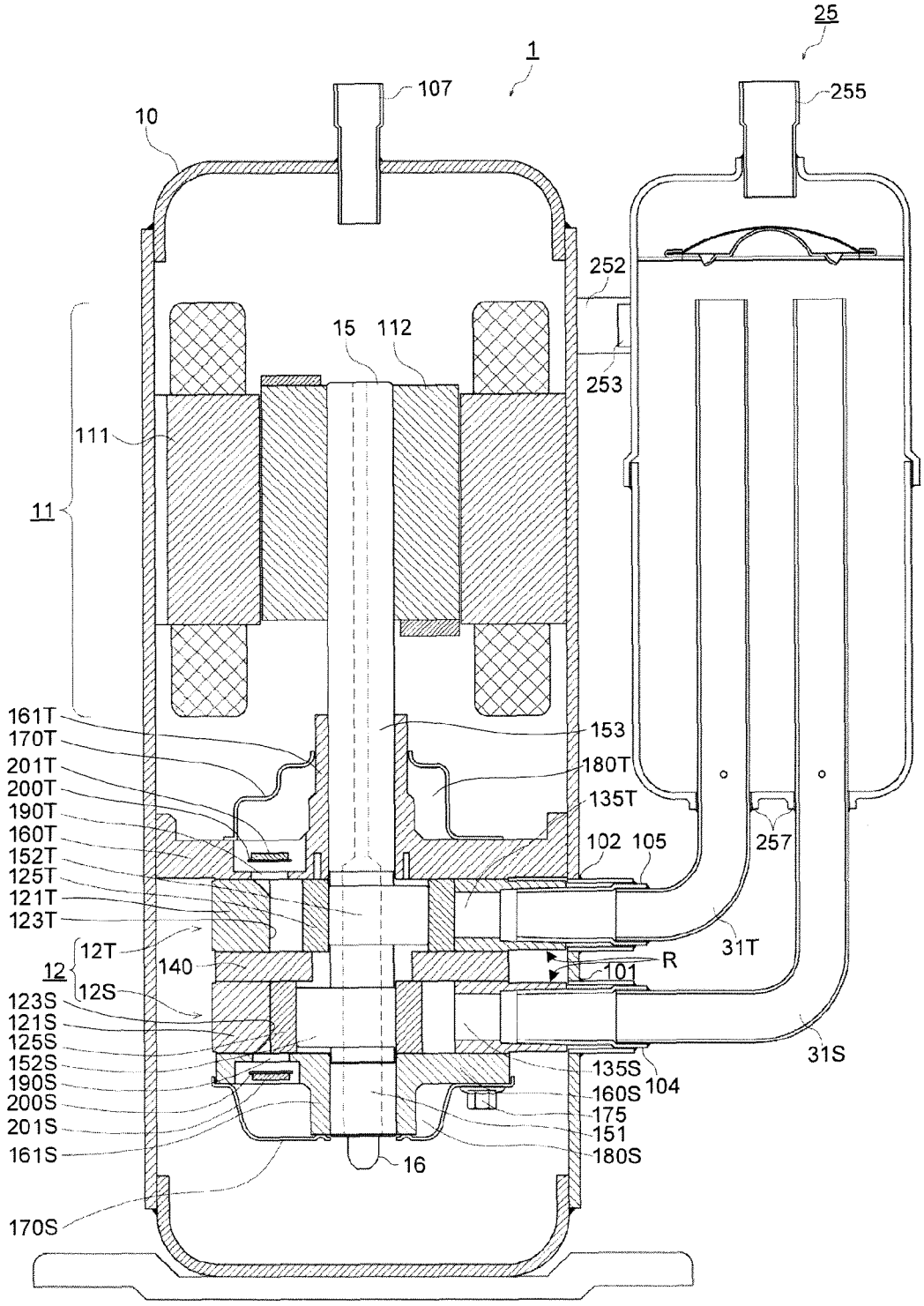
FIG. 1 is a longitudinal sectional view illustrating an embodiment of the rotary compressor according to the present invention.
Figure 2:
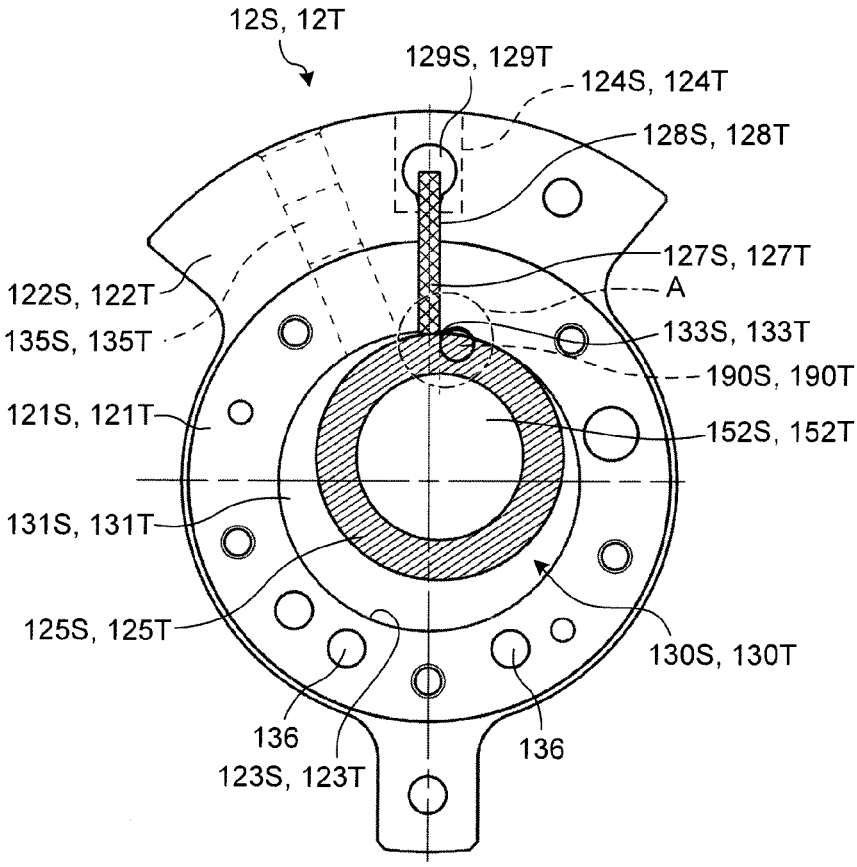
FIG. 2 is a plan view illustrating first and second compression units of a first embodiment.

FIG. 1 is a longitudinal sectional view illustrating an embodiment of the rotary compressor according to the present invention, and FIG. 2 is a plan view illustrating the first and second compression units of a first embodiment.

As illustrated in FIG. 1, a rotary compressor 1 of the embodiment includes a compression unit 12 arranged at the lower portion of a compressor casing 10 having a hermetic cylindrical shape and to be placed vertically, and a motor 11 which is arranged at the upper portion of the compressor casing 10 and drives the compression unit 12 via a rotary shaft 15.

A stator 111 of the motor 11 having a cylindrical form is fixed on the inner circumferential surface of the compressor casing 10 by shrink fit. A rotor 112 of the motor 11 is arranged inside the cylindrical stator 111 and fixed by shrink fit to a rotary shaft 15 which mechanically connects the motor 11 and the compression unit 12.

The compression unit 12 includes a first compression unit 12S, and a second compression unit 12T which is arranged in parallel with the first compression unit 12S and stacked above the first compression unit 12S. As illustrated in FIG. 2, the first and second compression units 12S, 12T include annular first and second cylinders 121S, 121T in which first and second suction ports 135S, 135T and first and second vane grooves 128S, 128T are provided radially in first and second lateral overhang portions 122S, 122T.

As illustrated in FIG. 2, in the first and second cylinders 121S, 121T, circular first and second cylinder inner walls 123S, 123T are formed concentrically with the rotary shaft 15 of the motor 11. In the first and second cylinder inner walls 123S, 123T, first and second annular pistons 125S, 125T with smaller outer diameter than cylinder inner diameter are arranged respectively, thereby forming first and second actuation chambers 130S, 130T which inhale, compress, and discharge refrigerant gas, between the first and second cylinder inner walls 123S, 123T and the first and second annular pistons 125S, 125T.

In the first and second cylinders 121S and 121T, the first and second vane grooves 128S, 128T which radially range the whole cylinder height from the first and second cylinder inner walls 123S, 123T are formed. In the first and second vane grooves 128S, 128T, tabular first and second vanes 127S, 127T are slidably fit, respectively.

As illustrated in FIG. 2, in the back portion of the first and second vane grooves 128S, 128T, first and second spring holes 124S, 124T are formed for communication from the outer circumferential portions of the first and second cylinders 121S, 121T to the first and second vane grooves 128S, 128T. In the first and second spring holes 124S, 124T, vane springs (not illustrated) which press against the back surfaces of the first and second vanes 127S, 127T are inserted. When starting up the rotary compressor 1, by repulsive power of the vane springs, the first and second vanes 127S, 127T protrude from the inside of the first and second vane grooves 128S, 128T into the first and second actuation chambers 130S, 130T, tips thereof abut against the outer circumferential surfaces of the first and second annular pistons 125S, 125T, and the first and second actuation chambers 130S, 130T are divided into first and second suction chambers 131S, 131T and first and second compression chambers 133S, 133T, by the first and second vanes 127S, 127T.

Additionally, at the first and second cylinders 121S, 121T, first and second pressure introduction passages 129S, 129T which communicate the back portions of the first and second vane grooves 128S, 128T with the inside of the compressor casing 10 via an opening portion R illustrated in FIG. 1 so as to introduce compressed refrigerant gas in the compressor casing 10 and apply back pressure by the pressure of the refrigerant gas.

At the first and second cylinders 121S, 121T, first and second suction ports 135S, 135T which communicate the first and second suction chambers 131S, 131T with the outside are provided for inhaling refrigerant from the outside into the first and second suction chambers 131S, 131T.

Additionally, as illustrated in FIG. 1, between the first cylinder 121S and the second cylinder 121T, a mid-division panel 140 is arranged so as to divide and cover the first actuation chamber 130S of the first cylinder 121S and the second actuation chamber 130T of the second cylinder 121T. At the lower end portion of the first cylinder 121S, a lower end plate 160S is arranged so as to cover the first actuation chamber 130S of the first cylinder 121S. Additionally, at the upper end portion of the second cylinder 121T, an upper end plate 160T is arranged so as to cover the second actuation chamber 130T of the second cylinder 121T.

At the lower end plate 160S, an auxiliary bearing portion 161S is formed. An auxiliary axis portion 151 of the rotary shaft 15 is rotatably supported by the auxiliary bearing portion 161S. At the upper end plate 160T, a main bearing portion 161T is formed. A main axis portion 153 of the rotary shaft 15 is rotatably supported by the main bearing portion 161T.

The rotary shaft 15 includes a first eccentric portion 152S and a second eccentric portion 152T whose phases are shifted by 180 degrees relative to each other so as to be eccentric. The first eccentric portion 152S is rotatably fit into the first annular piston 125S of the first compression unit 12S. The second eccentric portion 152T is rotatably fit into the second annular piston 125T of the second compression unit 12T.

When the rotary shaft 15 rotates, the first and second annular pistons 125S, 125T revolve in the counterclockwise direction in FIG. 2 in the first and second cylinders 121S, 121T along the first and second cylinder inner walls 123S, 123T, followed by the first and second vanes 127S, 127T reciprocating. By the motions of the first and second annular pistons 125S, 125T and the first and second vanes 127S, 127T, the volume of the first and second suction chambers 131S, 131T and the first and second compression chambers 133S, 133T continuously changes, and the compression unit 12 continuously inhales the refrigerant gas so as to compress and discharge the same. A characteristic configuration of the compression unit 12 is described below.

As illustrated in FIG. 1, under the lower end plate 160S, a lower muffler cover 170S is arranged so as to form a lower muffler chamber 180S between the lower end plate 160S and the same. And, the first compression unit 12S is open into the lower muffler chamber 180S. Namely, near the first vane 127S of the lower end plate 160S, a first discharge port 190S (refer to FIG. 2) which communicates the first compression chamber 133S of the first cylinder 121S with the lower muffler chamber 180S is provided, and at the first discharge port 190S, a reed valve type first discharge valve 200S, which prevents the compressed refrigerant gas from flowing in reverse, is arranged.

The lower muffler chamber 180S is a chamber which is annularly formed, and a portion of a communication passage which communicates the discharge side of the first compression unit 12S with the inside of an upper muffler chamber 180T through a refrigerant passage 136 (refer to the FIG. 2) which passes through the lower end plate 160S, the first cylinder 121S, the mid-division panel 140, the second cylinder 121T, and the upper end plate 160T. The lower muffler chamber 180S reduces pressure pulsation of the discharged refrigerant gas. Additionally, a first discharge valve holder 201S for restricting flexure opening valve volume of the first discharge valve 200S is fixed by a rivet with the first discharge valve 200S, overlapping the first discharge valve 200S. The first discharge port 190S, the first discharge valve 200S, and the first discharge valve holder 201S configure a first discharge valve portion of the lower end plate 160S.

As illustrated in FIG. 1, over the upper end plate 160T, an upper muffler cover 170T is arranged so as to form an upper muffler chamber 180T between the upper end plate 160T and the upper muffler cover 170T. Near the second vane 127T of the upper end plate 160T, a second discharge port 190T (refer to FIG. 2), which communicates the second compression chamber 133T of the second cylinder 121T with the upper muffler chamber 180T, is provided, and at the second discharge port 190T, a reed valve type second discharge valve 200T, which prevents the compressed refrigerant gas from flowing in reverse, is arranged. Additionally, a second discharge valve holder 201T for restricting flexure opening valve volume of the second discharge valve 200T is fixed by the rivet with the second discharge valve 200T, overlapping the second discharge valve 200T. The upper muffler chamber 180T reduces pressure pulsation of the discharged refrigerant gas. The second discharge port 190T, the second discharge valve 200T, and the second discharge valve holder 201T configure a second discharge valve portion of the upper end plate 160T.

The first cylinder 121S, the lower end plate 160S, the lower muffler cover 170S, the second cylinder 121T, the upper end plate 160T, the upper muffler cover 170T, and the mid-division panel 140 are integrally fastened by a plurality of through bolts 175 and the like. In the compression unit 12 which is integrally fastened by the through bolts 175 and the like, the outer circumferential portion of the upper end plate 160T is secured to the compressor casing 10 by spot welding so as to fix the compression unit 12 to the compressor casing 10.

On the outer circumferential wall of the cylindrical compressor casing 10, axially spaced first and second through holes 101, 102, from bottom to top, are provided for passing first and second suction pipes 104, 105. Additionally, on the outer portion of the compressor casing 10, an accumulator 25 composed of an independent cylindrical closed container is held by an accumulator holder 252 and an accumulator band 253.

To the center of the ceiling portion of the accumulator 25, a system connecting pipe 255 to be connected with an evaporator of the refrigeration cycle is connected. To a bottom through hole 257 provided on the bottom portion of the accumulator 25, first and second low pressure communication pipes 31S, 31T, of which one end extends to the upper portion of the interior of the accumulator 25 and the other end is connected to the other end of the first and second suction pipes 104, 105, are connected.

The first and second low pressure communication pipes 31S, 31T, which guide the low pressure refrigerant of the refrigeration cycle to the first and second compression units 12S, 12T through the accumulator 25, are connected to the first and second suction ports 135S, 135T (refer to FIG. 2) of the first and second cylinders 121S, 121T through the first and second suction pipes 104, 105 as suction portions. Namely, the first and second suction ports 135S, 135T are connected in parallel with the evaporator of the refrigeration cycle.

To the ceiling portion of the compressor casing 10, a discharge pipe 107 as a discharge portion which connects with the refrigerant cycle so as to discharge high pressure refrigerant gas to the condenser side of the refrigeration cycle. Namely, the first and second discharge ports 190S, 190T are connected to the condenser of the refrigeration cycle.

In the compressor casing 10, lubrication oil is enclosed approximately to the level of the second cylinder 121T. In addition, the lubrication oil is absorbed from a feed oil pipe 16 attached to the lower end portion of the rotary shaft 15 by a wing pump (not illustrated) inserted into the lower portion of the rotary shaft 15, and circulates in the compression unit 12 so as to lubricate sliding parts as well as sealing tiny gaps of the compression unit 12.

Figure 3:
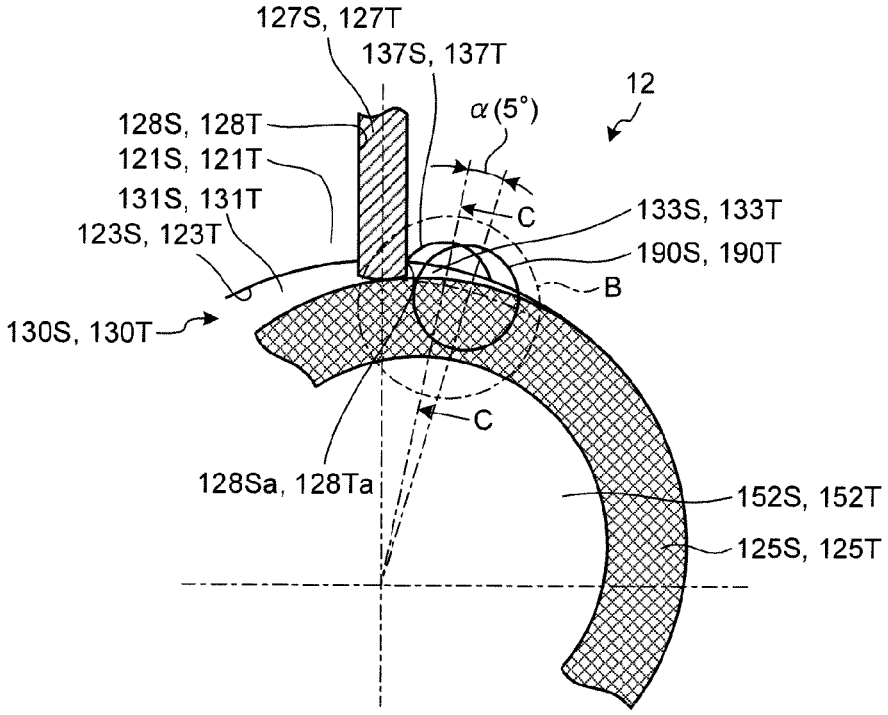
FIG. 3 is an enlarged cross-sectional view of A portion of FIG. 2.
Figure 4:
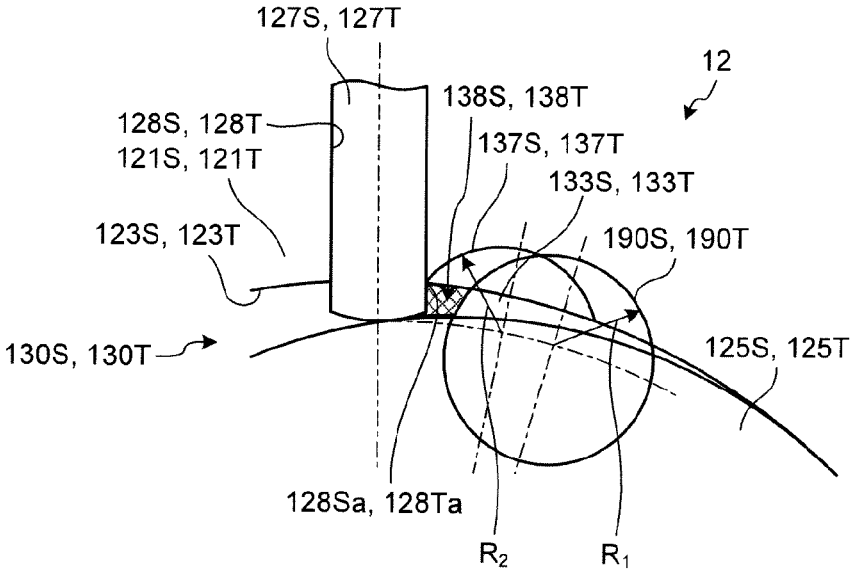
FIG. 4 is an enlarged cross-sectional view of B portion of FIG. 3.
Figure 5:
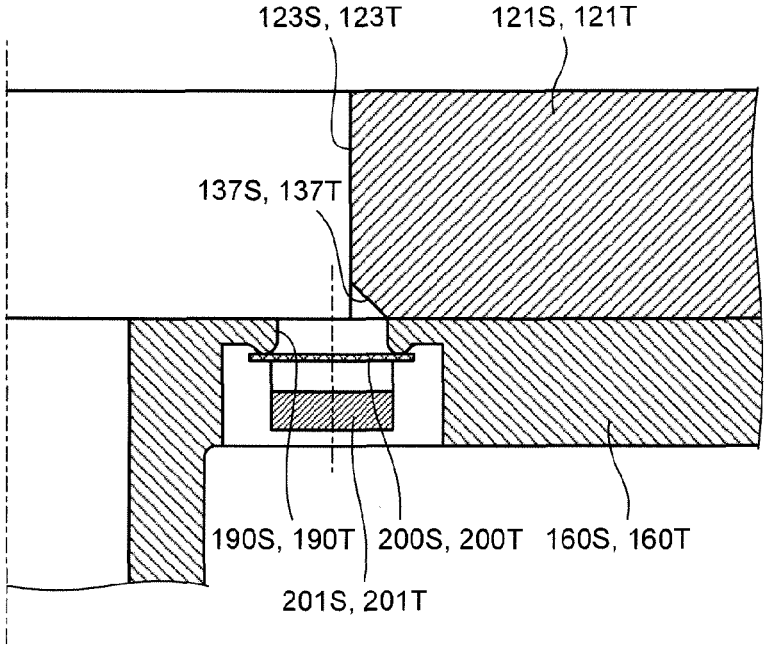
FIG. 5 is a C-C line cross-sectional view of FIG. 3.

Next, a characteristic configuration of the rotary compressor 1 of the first embodiment is described, referring to FIG. 1 to FIG. 5. FIG. 3 is an enlarged cross-sectional view of A portion of FIG. 2. FIG. 4 is an enlarged cross-sectional view of B portion of FIG. 3. FIG. 5 is a cross-sectional view along a C-C line of FIG. 3.

On the first and second compression chambers 133S, 133T side of the lower end plate 160S and the upper end plate 160T, the first and second discharge ports 190S, 190T which communicate with the first and second compression chambers 133S, 133T are provided near the first and second vane grooves 128S, 128T. Parts of the first and second discharge ports 190S, 190T are located outside the first and second cylinder inner walls 123S, 123T.

Near the first and second vane grooves 128S, 128T of the first and second cylinder inner walls 123S, 123T, first and second discharge grooves 137S, 137T are formed. The first and second discharge grooves 137S, 137T communicate the first and second compression chambers 133S, 133T with the first and second discharge ports 190S, 190T. One side end portions of the first and second discharge grooves 137S, 137T are located in end portions 128Sa, 128Ta of the wall portions of the first and second vane grooves 128S, 128T on the compression chamber side.

The first and second discharge grooves 137S, 137T are formed in a semicircular shape (or a semicircular cone shape) with a curvature radius $R_2$ which is equal or approximate to a radius $R_1$ of the first and second discharge ports 190S, 190T ($0.9R_1 \leq R_2 \leq 1.1R_1$, for example), and the semicircular shape inclines in the manner that a depth thereof becomes deeper as a position thereof approaches the lower and upper end plates 160S, 160T. The center of the curvature radius $R_2$ is formed so as to be offset by a predetermined angle $\alpha$ (five degrees in the first embodiment) from the center of the first and second discharge ports 190S, 190T to the first and second vane grooves 128S, 128T side. As illustrated in FIG. 5, the first and second discharge grooves 137S, 137T are formed only in the parts of the first and second cylinder inner walls 123S, 123T near the lower and upper end plates 160S, 160T. This is because if the first and second discharge grooves 137S, 137T are formed over the entire vertical direction of the first and second cylinder inner walls 123S, 123T, mechanical strength of the first and second cylinders 121S, 121T declines, and also the compressed refrigerant gas accumulated in the first and second discharge grooves 137S, 137T flows in reverse into the first and second compression chambers 133S, 133T causing decline in volumetric efficiency of the compressed refrigerant.

In the rotary compressor 1 of the embodiment, even after the first and second annular pistons 125S, 125T thereof revolve in the counterclockwise direction, the contact point between the first and second annular pistons 125S, 125T and the first and second cylinder inner walls 123S, 123T approaches the first and second vane grooves 128S, 128T, and the first and second annular pistons 125S, 125T completely cover the first and second discharge ports 190S, 190T, the first and second discharge grooves 137S, 137T communicate first and second small spaces 138S, 138T (refer to FIG. 4) of the first and second compression chambers 133S, 133T with the first and second discharge ports 190S, 190T and relieve the compressed refrigerant gas in the first and second small spaces 138S, 138T to the first and second discharge ports 190S, 190T so as to prevent over compression of refrigerant, decrease over compression loss, improve compression effect, and improve COP.

Second Embodiment

Figure 6:
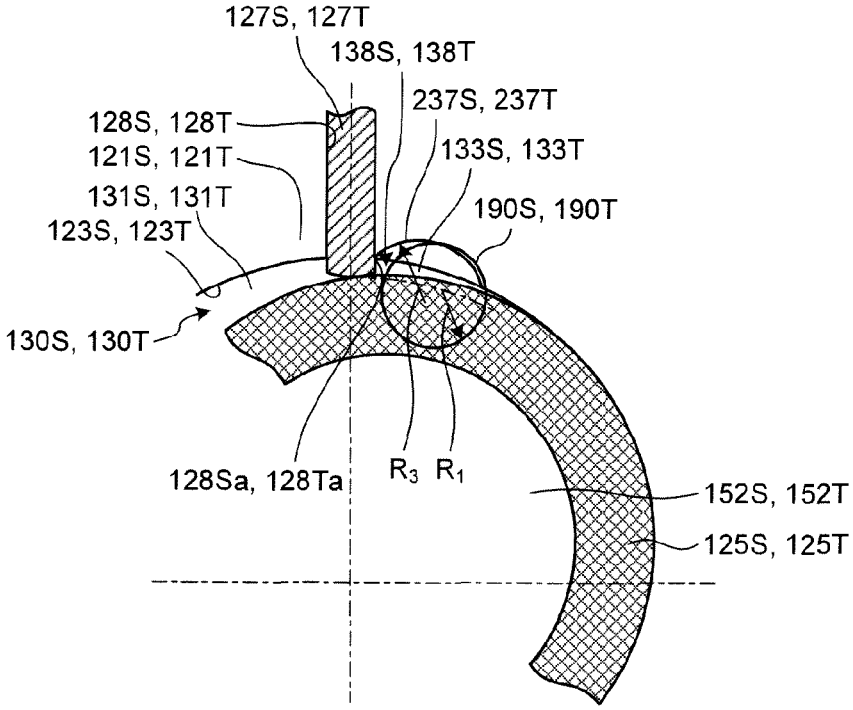
FIG. 6 is an enlarged cross-sectional view illustrating first and second compression units of a second embodiment.
Figure 7:
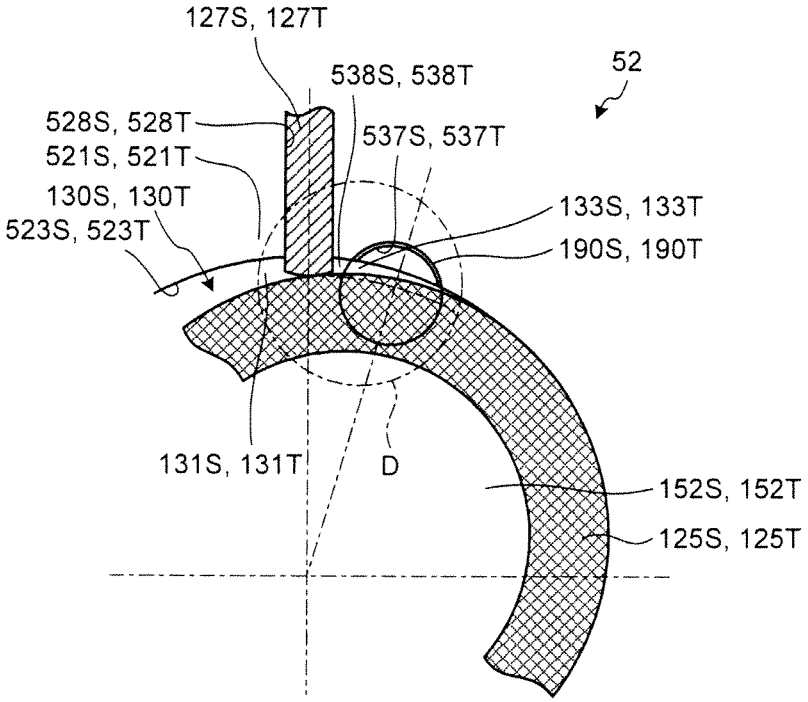
FIG. 7 is an enlarged cross-sectional view illustrating the first and second compression units of the conventional rotary compressor.
Figure 8:
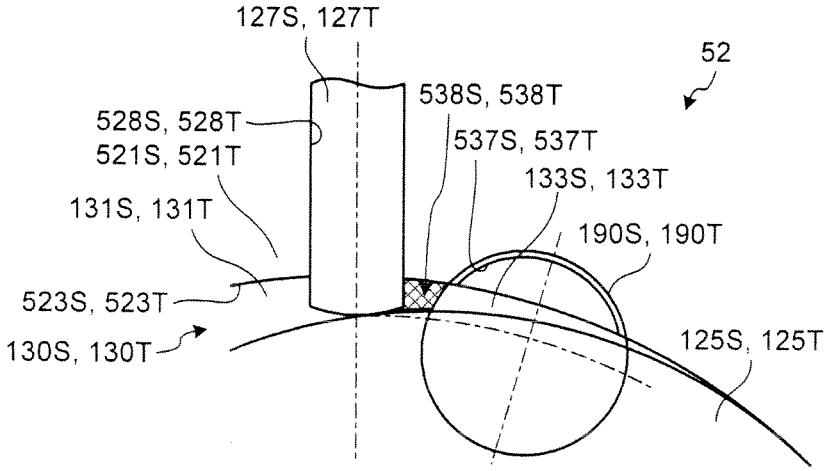
CONVENTIONAL ART FIG.8
FIG. 8 is an enlarged cross-sectional view of D portion of FIG. 7.

Next, a characteristic configuration of the rotary compressor 1 of a second embodiment is described, referring to FIG. 6 which is an enlarged cross-sectional view of the first and second compression units of the second embodiment.

As illustrated in FIG. 6, the first and second discharge ports 190S, 190T, which communicate with the first and second compression chambers 133S, 133T, are provided on the lower end plate 160S (refer to FIG. 1) and the upper end plate 160T on the first and second compression chambers 133S, 133T side near the first and second vane grooves 128S, 128T. Parts of the first and second discharge ports 190S, 190T are located outside the first and second cylinder inner walls 123S, 123T.

Near the first and second vane grooves 128S, 128T of the first and second cylinder inner walls 123S, 123T, first and second discharge grooves 237S, 237T are formed. The first and second discharge grooves 237S, 237T communicate the first and second compression chambers 133S, 133T with the first and second discharge ports 190S, 190T. One side end portions thereof are located in end portions 128Sa, 128Ta of the wall portions of the first and second vane grooves 128S, 128T on the compression chamber side.

The first and second discharge grooves 237S, 237T are formed in a semicircular shape (or a semicircular cone shape) with a curvature radius $R_3$ which is larger than a radius $R_1$ of the first and second discharge ports 190S, 190T, and the semicircular shape inclines in the manner that a depth thereof becomes deeper as a position thereof approaches the lower and upper end plates 160S, 160T. The first and second discharge grooves 237S, 237T communicate with the majority of the part, which is located outside the first and second cylinder inner walls 123S, 123T, of the first and second discharge ports 190S, 190T.

In the rotary compressor 1 of the second embodiment, even after the first and second annular pistons 125S, 125T thereof revolve in the counterclockwise direction, the contact point between the first and second annular pistons 125S, 125T and the first and second cylinder inner walls 123S, 123T approaches the first and second vane grooves 128S, 128T, and the first and second annular pistons 125S, 125T completely cover the first and second discharge ports 190S, 190T, the first and second discharge grooves 237S, 237T communicate first and second small spaces 138S, 138T (refer to FIG. 6) of the first and second compression chambers 133S, 133T with the first and second discharge ports 190S, 190T and relieve the compressed refrigerant gas in the first and second small spaces 138S, 138T to the first and second discharge ports 190S, 190T so as to prevent over compression of refrigerant, decrease over compression loss, improve compression effect, and improve COP.

Since the first and second discharge grooves 237S, 237T of the second embodiment communicate with the majority of the part, which is located outside the first and second cylinder inner walls 123S, 123T, of the first and second discharge ports 190S, 190T, flow resistance is low when relieving the compressed refrigerant gas in the first and second small spaces 138S, 138T to the first and second discharge ports 190S, 190T.

Note that, while the embodiments of the two cylinder type rotary compressor have been described in the first and second embodiments, the rotary compressor of the present invention can be applied to a single cylinder type rotary compressor and a two stage compression type rotary compressor.

The present invention provides the benefit of obtaining a rotary compressor whose over compression loss is low, compression effect is high, and COP of the whole refrigeration cycle thereof is high.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A rotary compressor comprising:

a compression unit including:

an annular cylinder including a suction port and a vane groove which are radially provided to a side portion of the annular cylinder;

an end plate which covers an end portion of the cylinder;

an annular piston which is fitted into an eccentric portion of a rotary shaft rotated by a motor and revolves in the cylinder along a cylinder inner wall of the cylinder so as to form an actuation chamber between the cylinder inner wall and the annular piston; and a vane which protrudes into the actuation chamber from an inside of the vane groove provided in the cylinder so as to abut against the annular piston and divide the actuation chamber into a suction chamber and a compression chamber, wherein a discharge port is provided in the end plate near the vane groove, the discharge port communicates with the compression chamber, and a part of the discharge port is located outside the cylinder inner wall, and a discharge groove is provided in the cylinder inner wall near the vane groove, the discharge groove communicates the compression chamber with the discharge port, and one side end portion of the discharge groove is located in an end portion of a wall portion of the vane groove on a compression chamber side, wherein the discharge groove is formed in a semicircular shape with a curvature radius $R_2$ which is equal or approximate to a radius $R_1$ of the discharge port, the semicircular shape inclining in a manner that a depth of the discharge groove becomes deeper as a position within the semicircular shape approaches the end plate, a center of the curvature radius $R_2$ being formed so as to be offset by a predetermined angle from a center of the discharge port to a vane groove side.

2. The rotary compressor according to claim 1, wherein the rotary compressor is a two cylinder type or a two stage compression type.

3. A rotary compressor comprising:

a compression unit including:

an annular cylinder including a suction port and a vane groove which are radially provided to a side portion of the annular cylinder;

an end plate which covers an end portion of the cylinder;

an annular piston which is fitted into an eccentric portion of a rotary shaft rotated by a motor and revolves in the cylinder along a cylinder inner wall of the cylinder so as to form an actuation chamber between the cylinder inner wall and the annular piston; and a vane which protrudes into the actuation chamber from an inside of the vane groove provided in the cylinder so as to abut against the annular piston and divide the actuation chamber into a suction chamber and a compression chamber, wherein a discharge port is provided in the end plate near the vane groove, the discharge port communicates with the compression chamber, and a part of the discharge port located outside the cylinder inner wall, and a discharge groove is provided in the cylinder inner wall near the vane groove, the discharge groove communicates the compression chamber with the discharge port, and one side end portion of the discharge groove is located in an end portion of a wall portion of the vane groove on a compression chamber side, wherein the discharge groove is formed in a semicircular shape with a curvature radius $R_3$ which is larger than a radius $R_1$ of the discharge port, the semicircular shape inclining in a manner that a depth of the discharge groove becomes deeper as a position within the semicircular shape approaches the end plate, and communicates with a majority of a part of the discharge port located outside the cylinder inner wall.

4. The rotary compressor according to claim 3, wherein the rotary compressor is a two cylinder type or a two stage compression type.

* * * * *